United States Patent [19]

Faulkner et al.

[11] 4,415,832

[45] Nov. 15, 1983

[54] ELECTRON MULTIPLIER HAVING AN IMPROVED PLANAR UTLIMATE DYNODE AND PLANAR ANODE STRUCTURE FOR A PHOTOMULTIPLIER TUBE

[75] Inventors: Richard D. Faulkner, Lancaster; Dale V. Henry, Willow Street; David L. Muth, East Petersburg, all of Pa.

[73] Assignee: RCA Corporation, New York, N.Y.

[21] Appl. No.: 323,260

[22] Filed: Nov. 20, 1981

[51] Int. Cl.[3] ..... H01J 40/00

[52] U.S. Cl. ..... 313/533; 313/105 R; 313/532

[58] Field of Search ..... 313/523–544, 313/103 R, 103 CM, 104, 105 R, 105 CM

[56] References Cited

U.S. PATENT DOCUMENTS

| | | | |
|---|---|---|---|
| 296,527 | 4/1904 | Butterwick | 24/363 |
| 2,200,722 | 5/1940 | Pierce et al. | 250/175 |
| 2,245,624 | 6/1941 | Teal | 250/175 |
| 2,866,914 | 12/1958 | Lallemand | 313/105 |
| 2,952,499 | 9/1960 | Carson | 316/1 |
| 3,260,878 | 7/1966 | Legoux | 313/104 |
| 3,433,944 | 3/1969 | George | 313/103 |

FOREIGN PATENT DOCUMENTS

| | | |
|---|---|---|
| 500447 | 2/1939 | United Kingdom . |
| 521077 | 5/1940 | United Kingdom . |

*Primary Examiner*—David K. Moore
*Assistant Examiner*—Robert E. Wise
*Attorney, Agent, or Firm*—Eugene M. Whitacre; Dennis H. Irlbeck; Vincent J. Coughlin, Jr.

[57] ABSTRACT

A photomultiplier tube comprises an electron multiplier assembly including a pair of oppositely-disposed insulative support spacers. A plurality of elements including an ultimate dynode and an anode are affixed to the support spacers. The ultimate dynode comprises a relatively inflexible multilateral hollow member having two plane-face surfaces lying at an acute angle to one another and terminating at a lower transverse edge. The ultimate dynode includes dynode mounting tabs extending from opposing ends thereof for affixing the ultimate dynode to the support spacers. The anode includes a substantially flat electron permeable mesh portion spaced from one of the plane-face surfaces of the ultimate dynode. Anode mounting tabs extend from opposing ends thereof for affixing the anode to the support spacers. Electrical leakage isolation slots are formed in the support spacers to increase the electrical leakage path length across the support spacers between the ultimate dynode and the anode.

8 Claims, 3 Drawing Figures

ELECTRON MULTIPLIER HAVING AN IMPROVED PLANAR UTLIMATE DYNODE AND PLANAR ANODE STRUCTURE FOR A PHOTOMULTIPLIER TUBE

BACKGROUND OF THE INVENTION

The present invention relates to an electron multiplier for a photomultiplier tube and more particularly to an electron multiplier having an improved planar ultimate dynode and a planar anode structure.

One embodiment of a conventional planar anode structure is shown in U.S. Pat. No. 2,200,722 issued to Pierce et al. on May 14, 1940. In the Pierce et al. structure, the anode comprises a metallic plate of relatively small area disposed within a screen electrode adjacent to the ultimate dynode. The anode is supported by a pair of bent wires extending through and fitted in suitable apertures in a pair of insulating uprights. The screen electrode operates at penultimate dynode potential to focus the electrons onto the anode. The flat anode plate supported on a pair of wires is neither mechanically stable nor inflexible and thus the anode may flex under temperature variations resulting in output signal instability or time-spread. Furthermore, the high field gradient arising from operating the anode within a screen electrode, which is at penultimate dynode potential, creates the possibility of high electrical leakage current to the anode.

An equally unsatisfactory anode configuration is shown in U.S. Pat. No. 2,245,624 issued to Teal on June 17, 1941. In one embodiment of the Teal patent, the anode comprises a metallic base plate supported from a cross-wire by a pair of rigid rods or wires. A second metallic plate is affixed to the base plate by welding. The second plate extends at an acute angle toward the ultimate dynode to form a collector. The Teal structure is unstable and difficult to manufacture in a reproducible manner.

U.S. Pat. No. 2,866,914 issued to Lallemand on Dec. 30, 1958 shows a wire grid anode disposed within a "Faraday Box". The anode is supported at one side by a lead-in wire that extends through an aperture in the side of the "Faraday Box". It is alleged that the anode is supported firmly; however, the single point of support located at one edge of the grid permits vibration or flexing of the anode under all but ideal operating conditions.

Thus, there is a need for a highly stable, simple planar anode and planar ultimate dynode structure having a minimum of electrical leakage between the two elements.

SUMMARY OF THE INVENTION

A photomultiplier tube comprises an electron multiplier assembly including insulative support means with a plurality of elements including an ultimate dynode and an anode affixed therebetween. The ultimate dynode comprises a relatively inflexible multilateral hollow member having two plane-face surfaces lying at an acute angle to one another and terminating at a lower transverse edge. The ultimate dynode includes integral dynode mounting means extending from opposing ends thereof for affixing the ultimate dynode to the support means. The anode includes a substantially flat electron permeable mesh portion spaced from one of the plane-face surfaces of the ultimate dynode. Anode mounting means extend from opposing ends thereof for affixing the anode to the support means. The support means include electrical leakage isolation means for increasing the electrical leakage path length across the support means between the ultimate dynode and the anode.

DESCRIPTION OF THE PREFERRED EMBODIMENT

Figure 1:
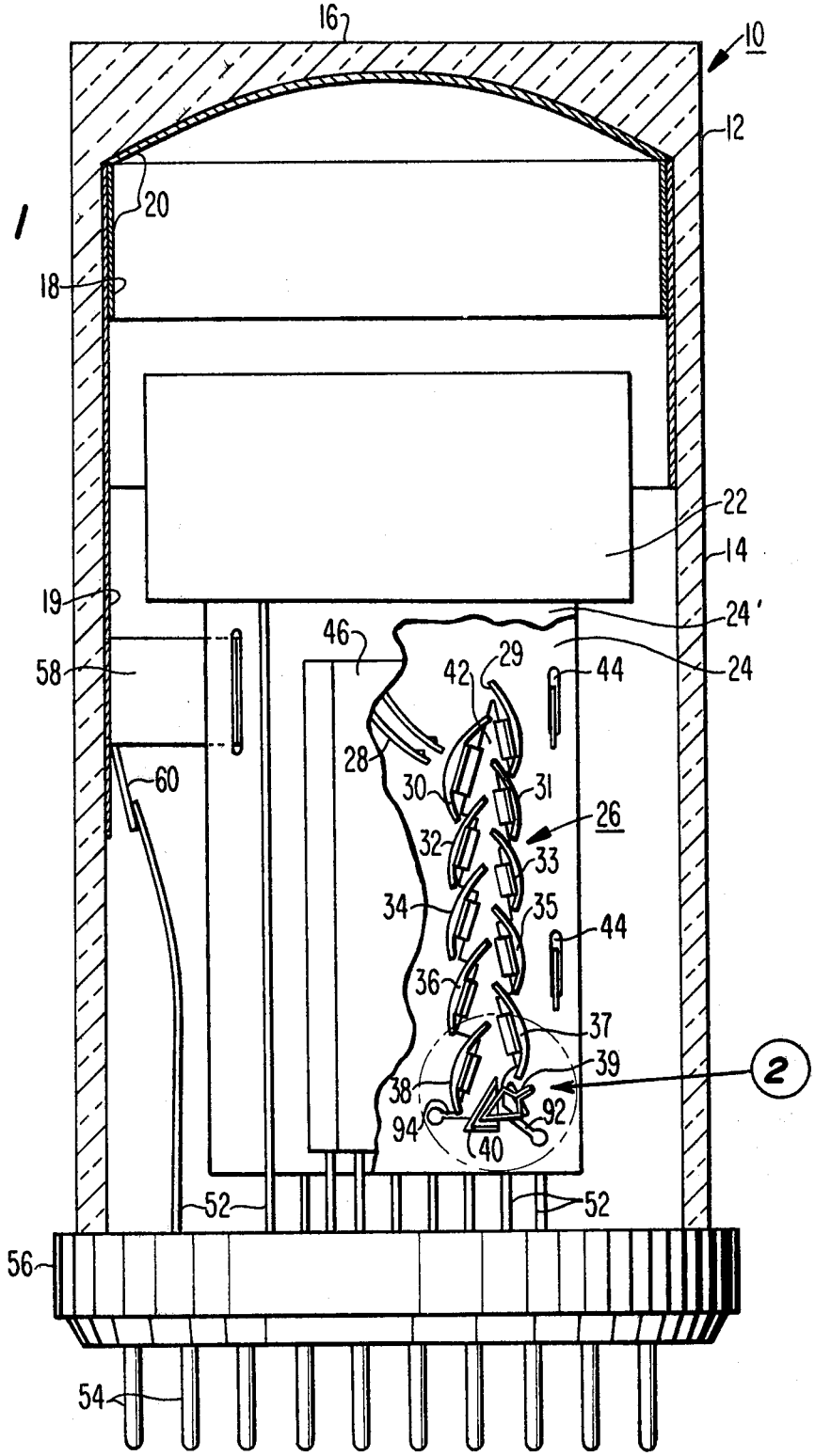
FIG. 1 is a partially cut-away side view of a photomultiplier tube in which an embodiment of the present invention is incorporated.
Figure 2:
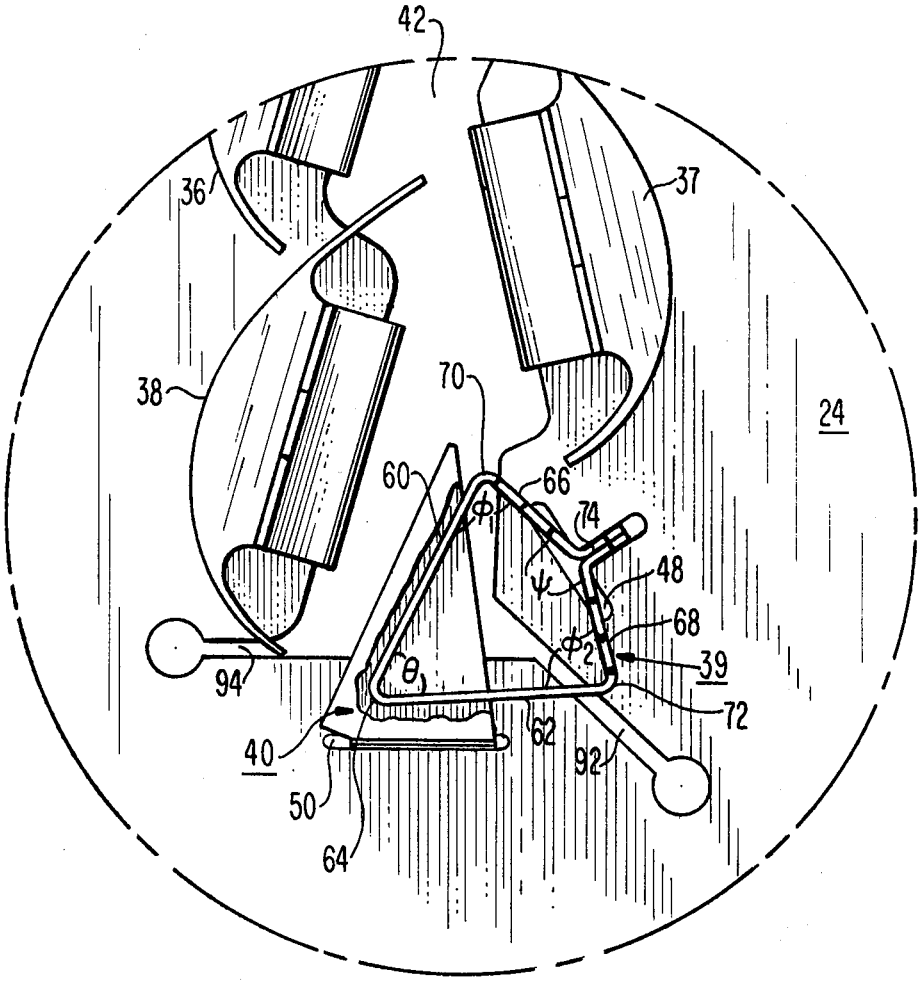
FIG. 2 is an enlarged view of the area within area 2 of FIG. 1.
Figure 3:
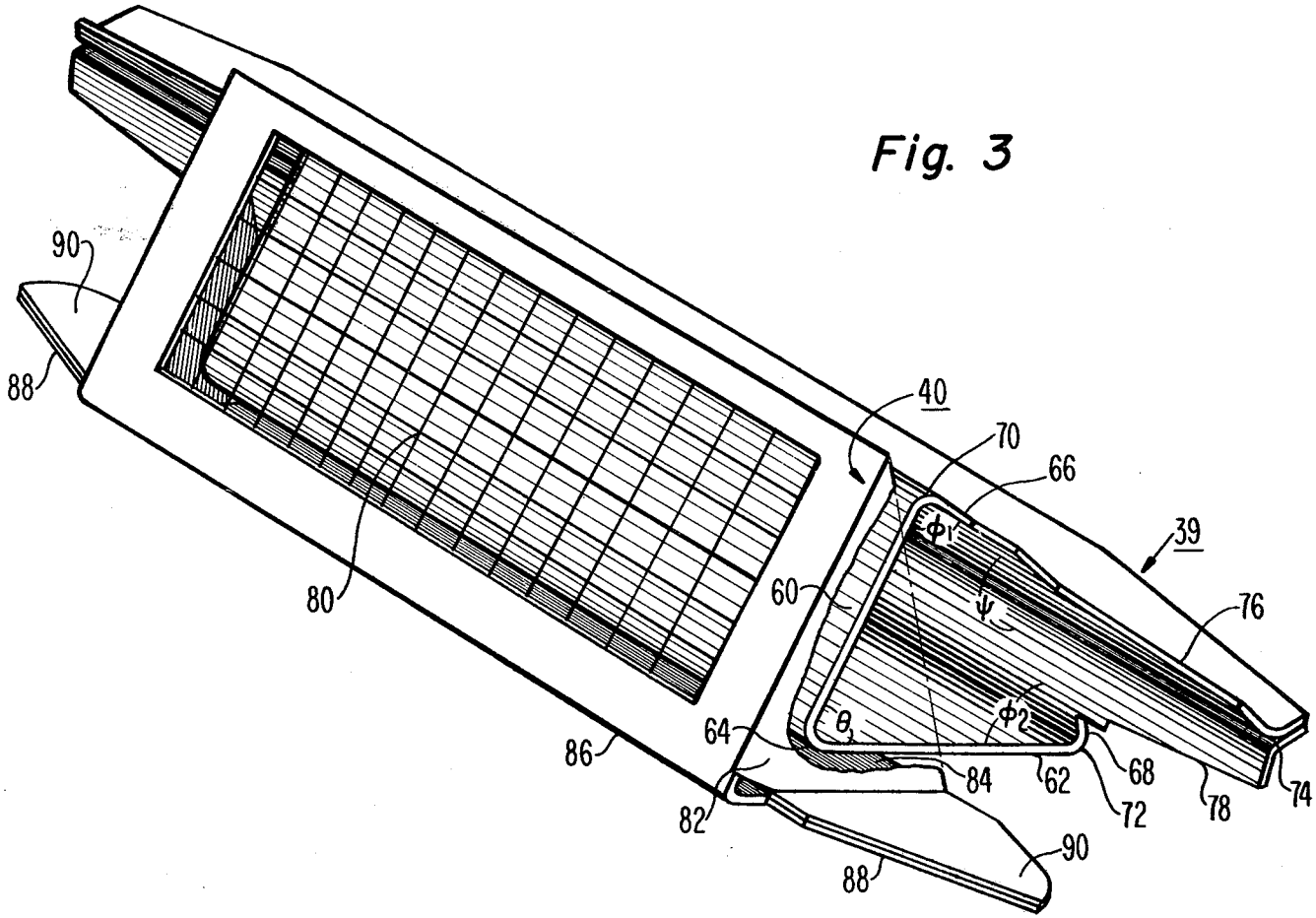
FIG. 3 is a perspective view of the novel anode and ultimate dynode.

Referring to FIGS. 1 through 3, there is shown a photomultiplier tube 10 comprising an evacuated envelope 12 having a generally cylindrical sidewall 14 and a faceplate 16. An aluminized coating 18 is disposed on an interior surface portion of the sidewall 14 adjacent to the faceplate 16. The coating 18 also includes a projection 19 that extends longitudinally along a portion of the sidewall 14. Within the tube 10 is a photoemissive cathode, hereinafter called a photocathode 20, on the interior surface of the faceplate 16 and also along a portion of the aluminum coating 18 on the sidewall 14. The photocathode 20 may be potassium-cesium-antimonide, for example, or any one of a number of photoemissive materials well known in the art. The photocathode 20 provides photoelectrons in response to radiation incident thereon.

The tube 10 is provided with a cup-shaped field forming electrode 22 which is spaced from the photocathode 20. The field forming electrode 22 is supported by a pair of oppositely-disposed support insulators 24 and 24'. The insulators 24 and 24' are substantially identical and comprise a ceramic material having high mechanical strength, such as Fotoceram, manufactured by Corning Glass Company, Corning, N.Y.

An electron multiplier assembly 26, comprising a primary dynode 28, a plurality of secondary dynodes consecutively numbered 29 through 39, and an anode 40 are spaced from the photocathode 20. The electron multiplier assembly 26 is generally described in copending U.S. patent application, Ser. No. 311,279 filed on Oct. 14, 1981 by Faulkner et al. assigned to the assignee of the present invention and incorporated herein for the purpose of disclosure. The electron multiplier assembly 26 differs from the electron multiplier described in the Faulkner et al. patent application in that the present structure utilizes a novel ultimate dynode 39, a novel anode 40 and improved dynode support spacers 24 and 24'. The primary dynode 28 and the secondary dynodes of the electron multiplier assembly 26 may be made of any conventional material such as, for example, berylliumcopper alloy. The dynodes and the photocathode are activated by a method well known in the art and described in copending U.S. patent application, Ser. No. 132,659 filed on Mar. 21, 1980 by Faulkner et al., now U.S. Pat. No. 4,311,939, assigned to the same assignee as the present invention and incorporated herein for the purpose of disclosure.

The primary dynode 28, the secondary dynodes 29 through 39, and the anode 40 are supported between the pair of oppositely-disposed support spacers, 24 and 24'. The support spacer 24 includes an elongated aperture 42 that substantially conforms to the shape of the interelectrode region along the electron path from the secondary dynode 29 to the ultimate dynode 39. A similar aperture 42 is formed in the support plate 24'. The apertures 42 remove insulating material from along the electron beam path extending from dynode 29 to dynode 39. Thus, dark current and count-rate instability caused by the electrostatic charging of the interior surfaces of the support plates by divergent secondary electrons striking the plates is reduced. A plurality of slit-like attachment slots 44 are formed in the support plates 24 and 24'. A pair of focusing shields 46 (only one of which is shown) are disposed along the exterior surface of the support plates 24 and 24' to provide a transverse electrostatic focusing field to prevent the secondary electrons produced by the secondary dynodes 29 through 39 from exiting from the multiplier array through the apertures 42 in the support plates 24 and 24'. The focusing shields 46 are attached to the attachment slots 44 and are preferably operated at a potential that is negative with respect to the potential on dynodes 30 through 39 to focus the secondary electrons inwardly, away from the interior surfaces of the support spacers 24 and 24'. The support spacers 24 and 24' having apertures 42 and slots 44 are discussed in detail in a copending patent application entitled, PHOTOMULTIPLIER TUBE HAVING IMPROVED COUNT-RATE STABILITY, Ser. No. 323,287, filed concurrently herewith and assigned to the same assignee as the present invention.

The support spacers 24 and 24' further include a plurality of mounting apertures formed therein for supporting the primary dynode 28, the secondary dynodes 29 through 39, and the anode 40. A substantially T-shaped ultimate dynode mounting aperture 48 and an anode mounting aperture 50 are shown in FIG. 2.

A plurality of conductive lead members 52 (only some of which are shown) extend between the electrode 22, the primary dynode 28, the secondary dynodes 29 through 39, the anode 40, and a plurality of terminals 54 in a base 56 attached to the tube 10. Potentials are applied to the various tube elements from an external source (not shown) through the terminals 54. The potentials are recited in the above-referenced Faulkner et al. patent application, Ser. No. 311,279 filed on Oct. 14, 1981.

Electrical connection to the photocathode 20 is provided by a contact member 58. The contact member 58 comprises a thin, resilient strip of metal, such as a nickel alloy which contacts the projection 19 of the aluminized coating 18. The contact member 58 is described in our copending U.S. patent application entitled, BROAD AREA CATHODE CONTACT FOR A PHOTOMULTIPLIER TUBE, Ser. No. 323,236, filed concurrently with the present patent application and assigned to the same assignee as the present invention. An electrical contact tab 60 is formed along one edge of the member about midway between the ends of the contact member 58. One of the conductive lead members 52 extends between the contact tab 60 and one of the terminals 54 in the base 56.

The novel ultimate dynode 39 comprises a thin strip of a beryllium-copper alloy that is formed into a multilateral hollow member having two plane-face surfaces 60 and 62 that lie at an acute angle, $\theta$, to one another and terminate at a lower transverse edge 64. The acute angle $\theta$ is typically about 65 degrees. The ultimate dynode 39 further includes two support surfaces 66 and 68. The support surface 66 is contiguous with the plane-face surface 60 and lies at an acute angle, $\phi_1$, therewith. The plane-face surface 60 and the support surface 66 terminate at a first upper transverse dynode edge 70. Correspondingly, the support surface 68 is contiguous with the plane-face surface 62 and lies at an acute angle, $\phi_2$, therewith. Typically, the acute angles $\phi_1$ and $\phi_2$ are about 72.5 degrees. The plane-face surface 62 and the support surface 68 terminate at a second upper transverse dynode edge 72. The support surfaces 66 and 68 contact one another at an obtuse angle, $\psi$, of about 150 degrees to form a seam 74 which extends outwardly from the obtuse angle $\psi$.

As shown in FIG. 3, the portion of the support surfaces 66 and 68 adjacent to the seam 74 comprise mounting tabs 76 and 78, respectively. The mounting tabs 76 and 78 include seam portions that lie parallel to one another and extend outwardly from the obtuse angle, $\psi$. The dynode mounting tabs 76 and 78 extend from opposite ends of the ultimate dynode for rigidly supporting the dynode within the T-shaped ultimate dynode mounting apertures 48 formed in the support spacers 24 and 24'. The novel ultimate dynode 39 described herein is a strong, inflexible member that is easily formed and mounted within the electron multiplier assembly 26.

The novel anode 40 includes a substantially flat electron permeable mesh portion 80 having an optical transmission of about 90 percent. An integral formable support portion 82 at either end of the mesh portion 80 is formed to provide a substantially rigid sidewall. An electron impermeable base portion 84 lies at an acute angle of about 65 degrees to the mesh portion 80. The mesh portion 80 and the base portion 84 terminate at a transverse anode edge 86. The anode base portion 84 includes a pair of base mounting tabs 88 extending from opposite ends of the base portion 84. The aforementioned formable support portions 82, at opposite ends of the mesh portion 80, terminate in support mounting tabs 90 which are substantially coextensive with the anode base mounting tabs 88, and together support the anode 40 within the anode mounting apertures 50 of the support spacers 24 and 24'. The above-described anode 40 is also strong, substantially inflexible yet easy to manufacture and mount within the electron multiplier assembly 26.

In order to increase the electrical leakage path length along the support spacers 24 and 24' between the ultimate dynode 39 and the anode 40, an electrical isolation slot 92 is formed in each of the support spacers 24 and 24'. To further electrically isolate the anode 40 from the penultimate dynode 38, a second electrical leakage isolation slot 94 is formed in each of the support spacers 24 and 24'. As shown in FIGS. 1 and 2, the isolation slots 92 and 94 are connected to the aperture 42.

What is claimed is:

1. In a photomultiplier tube having an electron multiplier assembly including insulative support means, a plurality of elements including an ultimate dynode and an anode, said elements being affixed to said support means, the improvement wherein said ultimate dynode comprises a relatively inflexible multilateral hollow member having two plane-face surfaces lying at an acute angle to one another and terminating at a lower transverse edge, said ultimate dynode including integral dynode mounting means extending from opposing ends thereof for affixing said ultimate dynode to said support means, said anode including a substantially flat electron permeable mesh portion spaced from one of said plane-face surfaces of said ultimate dynode, said anode having integral anode mounting means extending from opposing ends thereof for affixing said anode to said support means, and electrical leakage isolation means formed in said support means for increasing the electrical leakage path length across said support means between said ultimate dynode and said anode.

2. In a photomultiplier tube having an electron multiplier assembly comprising a plurality of dynodes including an ultimate dynode, an anode and a pair of oppositely-disposed insulative support spacers, each of said support spacers having a plurality of mounting apertures therethrough including an ultimate dynode mounting aperture and an anode mounting aperture for supporting said dynodes and said anode therein, the improvement wherein said ultimate dynode comprises a relatively inflexible hollow member having two plane-face surfaces lying at an acute angle to one another and terminating at a lower transverse dynode edge, said dynode including two support surfaces, each of said support surfaces being contiguous with and lying at an angle to a different one of said plane-face surfaces thereby forming an upper transverse dynode edge at the terminus of each plane-face surface and each support surface, said support surfaces contacting one another thereby forming a seam, said support surfaces adjacent to said seam having dynode mounting tabs extending from opposite ends thereof for supporting said dynode within said ultimate dynode mounting apertures in said support spacers, said anode including a substantially flat electron permeable mesh portion and a base portion lying at an acute angle to one another and terminating at a lower anode edge, said base portion including anode base mounting tabs extending from opposite ends thereof for supporting said anode within said anode mounting apertures in said support spacers, and said support spacers including an electrical leakage isolation slot formed in each of said support spacers, said slot being disposed between said ultimate dynode mounting aperture and said anode mounting aperture thereby increasing the electrical leakage path length between said ultimate dynode and said anode.

3. The tube as in claim 2 wherein said angle between each of said plane-face surfaces and each of said support surfaces of said ultimate dynode is an acute angle.

4. The tube as in claim 3 wherein said support surfaces contact one another at an obtuse angle to form said seam.

5. The tube as in claim 4 wherein said support surfaces forming said seam extend outwardly from said obtuse angle and lie parallel to one another to form a portion of said dynode mounting tab.

6. The tube as in claim 2 wherein said electron permeable mesh portion of said anode includes an integral formable support portion at either end thereof that is formed to provide a substantially rigid sidewall that contacts said base, each of said support portions terminating in a mounting tab that is substantially coextensive with said anode base mounting tab and supports said anode relatively inflexibly within said anode mounting apertures.

7. The tube as in claim 2 wherein said base portion of said anode is electron impermeable.

8. The tube as in claim 2 wherein said support spacers also include a second electrical leakage isolation slot disposed between a penultimate dynode of said plurality of dynodes and said anode.

* * * * *